US006861190B2

(12) United States Patent
Yamazaki et al.

(10) Patent No.: US 6,861,190 B2
(45) Date of Patent: Mar. 1, 2005

(54) TONER

(75) Inventors: Masahito Yamazaki, Wakayama (JP); Koji Kameyama, Wakayama (JP); Koji Akiyama, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/373,729

(22) Filed: Feb. 27, 2003

(65) Prior Publication Data

US 2003/0165762 A1 Sep. 4, 2003

(30) Foreign Application Priority Data

Feb. 28, 2002 (JP) ..... 2002-053554

(51) Int. Cl.[7] ..... G08G 9/08

(52) U.S. Cl. ..... 430/108.7; 430/108.6; 430/120

(58) Field of Search ..... 430/108.6, 108.7, 430/108.1, 120

(56) References Cited

U.S. PATENT DOCUMENTS 6,156,471 A * 12/2000 Kobori et al. ..... 430/108.6

OTHER PUBLICATIONS

US Patent & Trademark "Trademark Electronic Search System" (TESS), updated on Aug. 21, 2004, printout, describing the US Registered Trademark Henschel Mixer, ser. No. 75599986.*

U.S. Appl. No. 10/669,559, filed Sep. 25, 2003, Kameyama et al.

Patent Abstracts of Japan, JP 5–142859, Jun. 11, 1993.

Patent Abstracts of Japan, JP 07–013386, Jan. 17, 1995.

Patent Abstracts of Japan, JP 08–015890, Jan. 19, 1996.

Patent Abstracts of Japan, JP 08–227171, Sep. 3, 1996.

Patent Abstracts of Japan, JP 09–288369, Nov. 4, 1997.

Patent Abstracts of Japan, JP 2000–214629, Aug. 4, 2000.

* cited by examiner

*Primary Examiner*—Janis L. Dote

(74) *Attorney, Agent, or Firm*—Oblon, Spivak, McClelland, Maier & Neustadt, PC

(57) ABSTRACT

A toner comprising a resin binder, a colorant, and externally-added inorganic fine particles, comprising large-particle size inorganic particles comprising 50% by volume or more of particles having a particle size of from 100 to 583.9 nm, and having a BET specific surface area of 1 to 40 $m^2/g$. The toner can be used for the development of a latent image formed in electrophotography, electrostatic recording method, electrostatic printing method or the like.

7 Claims, No Drawings

TONER

BACKGROUND OF THE INVENTION

1. Field of the Invention

The present invention relates to a toner used for the development of a latent image formed in electrophotography, electrostatic recording method, electrostatic printing method or the like.

2. Discussion of the Related Art

In processes for development of toner, a non-contact development method, in which toner on a development roller is projected onto an electrostatic latent image carrying member with applying an electric field to the toner, has been proposed from the viewpoint of attaining high image quality, contrary to a contact development method in which a development roller is contacted with an electrostatic latent image carrying member such as a photoconductor via a magnetic brush or the like. However, in the non-contact development method, the development efficiency is low, so that reduction of the adhesive force of toner to carrier or toner carrying member and the like is required.

The above-mentioned problem can be solved by lowering the triboelectric charges of toner, but when the triboelectric charges of toner are reduced, toner scattering is likely to be caused. In order to overcome this drawback, various techniques for lowering the van der Waals forces, such as addition of inorganic fine particles having a large particle size with a particle size of from about 20 to about 100 nm (Japanese Patent Laid-Open Nos. Hei 8-15890, Hei 8-227171 and Hei 9-288369), defining adhesive force between toners (Japanese Patent Laid-Open No. Hei 7-13386) and studies on the particle size distribution or the form factor of toner (Japanese Patent Laid-Open Nos. 2000-214629 and Hei 5-142859) have been studied. However, in a long-term durable printing, decrease in image density or generation of void are still observed, so that there is a need to solve these problems.

An object of the present invention is to provide a toner capable of obtaining high-quality fixed image with little decrease in image density and little generation of void even in a long-term durable printing using a non-contact development device.

These and other objects of the present invention will be apparent from the following description.

SUMMARY OF THE INVENTION

The present inventors have found that prevention of decrease in image density and generation of void during a long-term durable printing using a non-contact development device can be controlled by the particle size distribution of inorganic fine particles having a low specific surface area (or a large particle size), which has not been studied, and have completed the present invention.

The present invention relates to (1) a toner comprising:

a resin binder, a colorant, and externally-added inorganic fine particles, comprising large-particle size inorganic particles comprising 50% by volume or more of particles having a particle size of from 100 to 583.9 nm, and having a BET specific surface area of 1 to 40 $m^2/g$; and (2) a process for development of a toner, comprising applying the toner of item (1) above to a development device for non-contact development.

DETAILED DESCRIPTION OF THE INVENTION

One of the features of the toner of the present invention resides in that large-particle size inorganic fine particles comprising 50% by volume or more of particles having a particle size of from 100 to 583.9 nm (hereinafter simply referred to as "large-particle size inorganic fine particles") are externally added.

When the particle size of the inorganic fine particles is less than 100 nm, decrease in image density is likely to be caused. On the other hand, when the particle size exceeds 583.9 nm, void is likely to be generated. Therefore, of the inorganic fine particles, the particles which function as an external additive have a particle size of from 100 to 583.9 nm, and at least one kind of inorganic fine particles comprising 50% by volume or more, preferably from 50 to 95% by volume, more preferably from 60 to 80% by volume, of the inorganic fine particles having the above-mentioned particle size are externally added. Incidentally, the void refers to a white spot generated when black solid image is printed. It is thought that void is generated because free inorganic fine particles are adhered to a photoconductor, thereby preventing the adhesion of toner thereto.

Further, the BET specific surface area of the large-particle size inorganic fine particles is 1 to 40 $m^2/g$, preferably from 5 to 35 $m^2/g$, more preferably from 5 to 20 $m^2/g$, from the viewpoint of markedly exhibiting the effects of the present invention. Incidentally, in the present invention, the BET specific surface area is determined by the nitrogen adsorption method.

The coefficient of variation of the large-particle size inorganic fine particles is preferably 65% or less, more preferably from 10 to 65%, especially from 20 to 45%, from the viewpoints of the effects of the present invention and the productivity.

The large-particle size inorganic fine particles include fine particles of silica, titania, alumina, zirconia, tin oxide, zinc oxide and the like. Among them, the fine particles of silica and titania are preferable, and the fine particles of silica are more preferable, from the viewpoint of more effectively obtaining the effects of the present invention. Among the silica fine particles, titanium oxide-doped silica, alumina-doped silica and titanium oxide-alumina-doped silica are preferable, more preferably titanium oxide-doped silica, from the viewpoint of more markedly exhibiting the effects of the present invention.

Further, it is preferable that the large-particle size inorganic fine particles are subjected to hydrophobic treatment, from the viewpoint of the stability in environmental resistance. The method of hydrophobic treatment is not particularly limited. The agent for hydrophobic treatment includes hexamethyldisilazane, n-butyltrimethoxysilane, dimethyldichlorosilane, dimethylsiloxane, silicone oil, methyltriethoxysilane, and the like. Among them, hexamethyldisilazane, n-butyltrimethoxysilane and dimethyldichlorosilane are preferable. It is preferable that the amount of the agent for hydrophobic treatment is from 1 to 7 $mg/m^2$ per surface area of the silica.

The content of the above-described large-particle size inorganic fine particles comprising 50% by volume or more of particles having a particle size of from 100 to 583.9 nm is preferably from 0.01 to 5 parts by weight, more preferably from 0.05 to 3 parts by weight, based on 100 parts by weight of the toner before the treatment with the external additive (untreated toner).

Although the reason why the effects of the present invention can be obtained by these constituents has not been clear, it is thought that the effects are obtained as a result of a combination of various factors as follows. The van der Waals forces between the toner and the toner carrying member or the like can be uniformly controlled by adding large-particle size inorganic fine particles having a specific particle size distribution; embedment and detachment of the large-particle size inorganic fine particles due to the stress in a non-contact development method are subtly balanced by adjusting the BET specific surface area of the large-particle size inorganic fine particles within a specific range; and the like.

Incidentally, other known inorganic fine particles or organic fine particles may be also used as an external additive for the toner as long as the effect of the large-particle size inorganic fine particles in the present invention is not impaired. In particular, by using small-particle size inorganic particles having a BET surface area exceeding 40 $m^2/g$, preferably those having a BET surface area of from 50 to 200 $m^2/g$, together with the large-particle size inorganic fine particles of the present invention, the flowability of the toner become excellent, so that the effects of the present invention are more markedly exhibited.

The small-particle size inorganic fine particles include fine particles of silica, titania, alumina, zirconia, tin oxide, zinc oxide and the like. Among them, the fine particles of silica and titania are preferable, from the viewpoint of more effectively obtaining the effects of the present invention.

The content of the small-particle size inorganic particles is preferably from 10 to 400 parts by weight, more preferably from 50 to 300 parts by weight, based on 100 parts by weight of the large-particle size inorganic fine particles.

The resin binder in the present invention includes polyesters, styrene-acrylic resins, hybrid resins, epoxy resins, polycarbonates, polyurethanes, and the like, without being particularly limited thereto. Among them, from the viewpoints of the dispersibility of the colorant and the transferability, the polyester and the hybrid resin are preferable, and the polyester is more preferable. The content of the polyester is preferably from 50 to 100% by weight, more preferably from 80 to 100% by weight, especially preferably 100% by weight, of the resin binder.

The term "hybrid resin" as referred to herein is a resin in which a condensation polymerization resin component, such as a polyester, is partially chemically bonded with an addition polymerization resin component such as a vinyl resin. The hybrid resin may be obtained by using two or more resins as raw materials, or it may be obtained by using one resin and raw material monomers of the other resin. Further, the hybrid resin may be obtained from a mixture of raw material monomers of two or more resins. In order to efficiently obtain a hybrid resin, those obtained from a mixture of raw material monomers of two or more resins are preferable.

The raw material monomer for the polyester includes an alcohol component comprising dihydric or higher polyhydric alcohols and a carboxylic acid component comprising dicarboxylic or higher polycarboxylic acid compounds.

It is preferable that the alcohol component contains a compound represented by the formula (I):

(I)

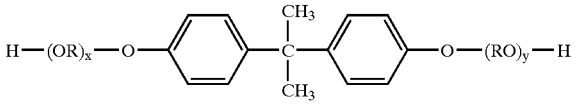

wherein R is an alkylene group having 2 or 3 carbon atoms; each of x and y is a positive number, wherein a sum of x and y is from 1 to 16, preferably from 1.5 to 5.0, from the viewpoints of the triboelectric chargeability and the durability.

The compound represented by the formula (I) includes alkylene(2 to 3 carbon atoms) oxide(average number of moles: 1 to 16) adduct of bisphenol A such as polyoxypropylene(2.2)-2,2-bis(4-hydroxyphenyl)propane and polyoxyethylene(2.2)-2,2-bis(4-hydroxyphenyl) propane, and the like. In addition, other alcohol component includes ethylene glycol, propylene glycol, glycerol, pentaerythritol, trimethylolpropane, hydrogenated bisphenol A, sorbitol, alkylene(2 to 4 carbon atoms) oxide(average number of moles: 1 to 16) adducts thereof, and the like.

It is desired that the content of the compound represented by the formula (I) in the alcohol component is 5% by mol or more, preferably 50% by mol or more, more preferably 100% by mol.

In addition, the carboxylic acid component includes dicarboxylic acids such as phthalic acid, isophthalic acid, terephthalic acid, fumaric acid and maleic acid; a substituted succinic acid of which substituent is an alkyl group having 1 to 20 carbon atoms or an alkenyl group having 2 to 20 carbon atoms, such as dodecenylsuccinic acid and octylsuccinic acid; trimellitic acid and pyromellitic acid; anhydrides of these acids; alkyl(1 to 3 carbon atoms) esters of these acids; and the like.

The polyester can be prepared by, for instance, polycondensation of an alcohol component with a carboxylic acid component at a temperature of 180° to 250° C. in an inert gas atmosphere under reduced pressure in the presence of an esterification catalyst as desired.

It is preferable that the polyester has a softening point of 95° to 160° C. and a glass transition point of 50° to 85° C., from the viewpoints of fixing ability and the durability.

As the colorants, all of the dyes, pigments and the like which are used as colorants for toners can be used, and the colorant includes carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, disazoyellow, and the like. These colorants can be used alone or in admixture of two or more kinds. In addition, the toner may be any of black toners, color toners and full-color toners. The content of the colorant is preferably from 1 to 40 parts by weight, more preferably from 3 to 10 parts by weight, based on 100 parts by weight of the resin binder.

The toner of the present invention may appropriately contain an additive such as a charge control agent, a releasing agent, a fluidity improver, an electric conductivity modifier, an extender, a reinforcing filler such as a fibrous substance, an antioxidant, an anti-aging agent, and a cleanability improver.

The charge control agent includes positively chargeable charge control agents such as Nigrosine dyes, triphenylmethane-based dyes containing a tertiary amine as a side chain, quaternary ammonium salt compounds, polyamine resins and imidazole derivatives, and negatively chargeable charge control agents such as metal-containing azo dyes, copper phthalocyanine dyes, metal complexes of alkyl derivatives of salicylic acid and boron complexes of benzilic acid. The toner of the present invention may be either positively chargeable or negatively chargeable. Also, a positively chargeable charge control agent and a negatively chargeable charge control agent may be used together.

The releasing agent includes waxes such as natural ester waxes such as carnauba wax and rice wax; synthetic waxes such as polypropylene wax, polyethylene wax and Fischer-Tropsch wax; petroleum waxes such as montan wax, alcohol waxes. These waxes may be contained alone or in admixture of two or more kinds.

The toner of the present invention is prepared by a surface treatment step comprising mixing an untreated toner with an external additive using a HENSCHEL MIXER or the like. The process for preparing the untreated toner may be any of conventionally known methods such as a kneading-pulverization method, an emulsion phase-inversion method and a polymerization method, and the kneading-pulverizing method is preferable from the viewpoint of easily preparing the toner. Incidentally, in the case of a pulverized toner prepared by the kneading-pulverizing method, the toner can be prepared by homogeneously mixing a resin binder, a colorant and the like in a mixer such as a HENSCHEL MIXER, thereafter melt-kneading with a closed kneader, a single-screw or twin-screw extruder, or the like, cooling, pulverizing, and classifying. In the emulsion phase-inversion method, the toner can be prepared by dissolving or dispersing a resin binder, a colorant and the like in an organic solvent, thereafter emulsifying the mixture by, for instance, adding water, and separating and classifying the particles. The toner has a volume-average particle size of preferably from 3 to 15 $\mu$m.

In the toner of the present invention, in order to enhance the effects of the present invention by controlling the adhesive force of the large-particle size inorganic fine particles, the content of substances having a number-average molecular weight of 500 or less is preferably from 1 to 4%, more preferably from 1.5 to 3% of the toner. In a preferred embodiment, the substances having a number-average molecular weight of 500 or less include substances originated from the resin binder component, and various additives such as stearic acid, preferably the substances from the resin binder component. Incidentally, the substances having a number-average molecular weight of 500 or less originated from the resin binder component include, for instance, raw material monomers, oligomer components thereof and the like.

The toner of the present invention has weak van der Waals forces with the toner carrying member and the like, and has an excellent durability, so that the effects of the present invention are more markedly exhibited by using the toner as a toner for non-contact development in which toner is projected from the toner carrying member to the electrostatic latent image carrying member such as a photoconductor.

In addition, the toner of the present invention can be used in any of monocomponent development and two-component development. The effects of the present invention are more markedly exhibited by using the toner of the present invention as a nonmagnetic toner having a lighter specific gravity. Therefore, it is preferable to use the toner of the present invention as a toner for nonmagnetic monocomponent development and a nonmagnetic toner for two-component development. In the present invention, the term "nonmagnetic toner" refers to a paramagnetic material, a diamagnetic material, or a magnetic material having a saturation magnetization of 10 $Am^2/kg$ or less, preferably 2.5 $Am^2/kg$ or less.

The present invention provides a process for development of a toner comprising applying the toner of the present invention to a development device for non-contact development.

EXAMPLES

[Particle Size]

Four grams of inorganic fine particles are placed in a glass bottle "M-140" (commercially available from Kashiwayo Glass Co., Ltd.) with dispersing them in 80 g of ethanol, and subjected to an ultrasonic treatment for 10 minutes. Thereafter, the particles size of the inorganic fine particles is determined under the conditions given below using a laser beam-type particle size distribution analyzer "LB 500" (commercially available from HORIBA, LTD.).

(Conditions for Determination)

| |
|---|
| Repeating times: 50 |
| Base for particle size: Volume |
| Refractive index of sample: 1.450–0.000 i |
| Refractive index of dispersion medium: 1.330 |
| Sample concentration: 1.1 to 3.1 V |

[BET Specific Surface Area]

The BET specific surface area is determined by the nitrogen adsorption method.

[Coefficient of Variation]

The coefficient of variation is calculated by the following equation using a measurement value with a laser beam-type particle size distribution analyzer "LB 500" (commercially available from HORIBA, LTD.).

Coefficient of Variation (%)=Arithmetic Standard Deviation/Volume-average Median Particle Size×100

[Content of Substances Having Number-average Molecular Weight of 500 or Less]

The molecular weight distribution is determined by gel permeation chromatography (GPC).

Ten milliliters of tetrahydrofuran is added to 30 mg of a toner, and the ingredients are mixed for 1 hour in a ball mill. Thereafter, the mixture is filtered using a fluororesin filter having a pore size of 2 $\mu$m, "FP-200" (commercially available from Sumitomo Electric Industries, Ltd.), to remove insoluble components to give a sample solution.

The measurement is taken by passing tetrahydrofuran as an eluate for the determination of molecular weight distribution at a flow rate of 1 ml per minute, stabilizing a column in a thermostat at 40° C., and injecting 100 $\mu$l of the sample solution. The content (%) of substances having a molecular weight of 500 or less is calculated as % by area of the corresponding area in the chart obtained from an RI (refractive index) detector. Incidentally, the column used for the analysis is "GMHLX+G3000HXL" (commercially available from Tosoh Corporation), and calibration curves are obtained using several types of monodispersed polystyrenes as a standard sample.

Resin Preparation Example 1

The amount 1225 g of polyoxypropylene(2.2)-2,2-bis(4-hydroxyphenyl)propane, 488 g of polyoxyethylene(2.0)-2,2-bis(4-hydroxyphenyl)propane, 324 g of terephthalic acid, 469 g of dodecenylsuccinic anhydride, 240 g of trimellitic anhydride and 4 g of dibutyltin oxide (esterification catalyst) were reacted at 230° C. for 8 hours at an atmospheric pressure under a nitrogen gas atmosphere. Thereafter, the ingredients were further reacted under reduced pressure, to give a resin A. The resulting resin had a softening point of 146° C., an acid value of 18 mg KOH/g, and a glass transition point of 62° C.

Resin Preparation Example 2

The amount 1225 g of polyoxypropylene(2.2)-2,2-bis(4-hydroxyphenyl)propane, 488 g of polyoxyethylene(2.0)-2,2-bis(4-hydroxyphenyl)propane, 470 g of terephthalic acid, 161 g of dodecenylsuccinic anhydride, 149 g of trimellitic anhydride and 4 g of dibutyltin oxide (esterification catalyst) were reacted at 230° C. for 8 hours at normal pressure under a nitrogen gas atmosphere. Thereafter, the ingredients were further reacted under reduced pressure, to give a resin B. The resulting resin had a softening point of 148° C., an acid value of 6 mg KOH/g, and a glass transition point of 63° C.

EXAMPLES 1 to 6 AND COMPARATIVE EXAMPLES 1 TO 3

The amount 100 parts by weight of a resin binder as shown in Table 1, 7 parts by weight of a carbon black "MOGUL L" (commercially available from Cabot Corporation), 1 part by weight of a charge control agent "T-77" (commercially available from Hodogaya Chemical Co., Ltd.) and 1 part by weight of a polypropylene wax "NP-055" (commercially available from MITSUI CHEMICALS, INC.) were mixed with a HENSCHEL MIXER, and melt-kneaded with a twin-screw kneader, to give a kneaded product. The resulting kneaded product was then cooled in the air, roughly pulverized and finely pulverized, and then classified, to give an untreated toner having a volume-average particle size of 8 μm.

To 100 parts by weight of the resulting untreated toner were added 0.5 parts by weight of inorganic fine particles as shown in Table 1 and 0.9 parts by weight of a hydrophobic silica "R 972" (commercially available from Nippon Aerosil). The ingredients were mixed with a HENSCHEL MIXER with stirring, to give a nonmagnetic toner. Incidentally, the particle size distribution of the inorganic fine particles used is shown in Table 2. Incidentally, the inorganic fine particles as shown in Table 2 were obtained by disintegrating commercially available inorganic fine particles with a HENSCHEL MIXER, thereafter removing coarse grains with a cyclone by means of jet stream transport, and collecting the fine particles using a Goatex dust-collecting filter commercially available from Hosokawa Micron Corp.

Test Example

A toner was loaded in an electrophotographic machine "MICROLINE 703 N" (commercially available from Oki Data Corporation) modified to be non-contact development-type by setting the distance between the photoconductor and the development sleeve to 80 μm. Fixed images were continuously printed out with a printing ratio of 10% up to the first 10000th sheet, and with a printing ratio of 2% for the 10000th sheet to 100000th sheet. The ratio of maintaining in image density and the ratio of generation of void were obtained according to the methods described below. The results are shown in Table 1.

[Ratio of Maintaining Image Density]

The optical reflective densities of the images of the 10000th sheet and the 100000th sheet were measured with a reflective densitometer "RD-915" (commercially available from Macbeth Process Measurements Co.). The ratio of the image density of the 100000th image ($OD_{10}$) to the image density of the 10001st image ($OD_1$)($OD_{10}/OD_1 \times 100$) is obtained.

[Ratio of Generation of Void]

The number of the voids per 10 sheets are counted, where white spots generated in the black solid images of 10001st to 10010th sheets are considered as voids.

TABLE 1

| | Resin Binder | Inorganic Fine Particles | Content of Substances Having Number-Average Molecular Weight of 500 or Less (%) | Ratio of Maintaining Image Density (%) | Ratio of Generation of Void (Spots/10 sheets) |
|---|---|---|---|---|---|
| Example 1 | Resin A | A | 2.2 | 98 | 4 |
| Example 2 | Resin B | A | 4.2 | 90 | 5 |
| Example 3 | Resin A | B | 2.2 | 87 | 4 |
| Example 4 | Resin A | C | 2.2 | 85 | 10 |
| Example 5 | Resin A | G | 2.2 | 98 | 2 |
| Example 6 | Resin A | H | 2.2 | 99 | 0 |
| Comparative Example 1 | Resin A | D | 2.2 | 62 | 8 |
| Comparative Example 2 | Resin A | E | 2.2 | 68 | 18 |
| Comparative Example 3 | Resin A | F | 2.2 | 51 | 11 |

TABLE 2

| | Inorganic Fine Particles | Agent for Hydrophobic Treatment | Content of Particles of 100 to 583.9 nm (% by vol.) | BET Specific Surface Area ($m^2/g$) | Coefficient of Variation (%) |
|---|---|---|---|---|---|
| A | Hydrophobic Silica | Hexamethyl-disilazane | 63.2 | 11.2 | 32.5 |
| B | Hydrophobic Silica | Hexamethyl-disilazane | 94.8 | 30.1 | 42.0 |
| C | Hydrophobic Titania | n-Butyl-trimethoxy-silane | 72.5 | 29.3 | 60.1 |
| D | Hydrophobic Silica | Hexamethyl-disilazane | 56.1 | 49.2 | 44.0 |
| E | Hydrophobic Silica | Hexamethyl-disilazane | 42.1 | 35.3 | 62.1 |
| F | Hydrophobic Titania | n-Butyl-trimethoxy-silane | 61.2 | 70.2 | 66.3 |
| G | Titanium Oxide (2% by weight)-Doped Hydrophobic Silica | Hexamethyl-disilazane | 67.3 | 8.5 | 52.0 |
| H | Titanium Oxide (10% by weight)-Doped Hydrophobic Silica | Hexamethyl-disilazane | 69.0 | 12.0 | 55.0 |

It is clear from the above results that the toners of Examples in which the inorganic fine particles having a desired particle size distribution and BET specific surface area are used can maintain sufficient image density after the durability printing test and small ratios of generation of void, as compared to the toners of Comparative Examples.

Especially in the cases of Examples 5 and 6 using titanium oxide-doped silica, the ratio of maintaining the image density becomes higher and the ratio of the generation of the void becomes very small. This is presumably due to the fact that the specific gravity of the particles is adjusted to an appropriate level by doping titanium oxide to silica, so that the adhesion of the inorganic fine particles to the toner can be more effectively carried out in the treatment process of externally adding the inorganic fine particles, whereby free inorganic particles can be markedly reduced.

According to the present invention, there can be provided a toner capable of obtaining high-quality fixed image with little decrease in image density and little generation of void even in a long-term durable printing using a non-contact development device.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner comprising:

a resin binder, a colorant, and externally-added inorganic fine particles, comprising large-particle size inorganic particles comprising 50% by volume or more of particles having a particle size of from 100 to 583.9 nm, and having a BET specific surface area of 1 to 40 $m^2/g$, wherein the large-particle size inorganic particles are silica fine particles.

2. The toner according to claim 1, wherein a coefficient of variation of a particle size distribution of the large-particle size inorganic fine particles is 65% or less.

3. The toner according to claim 1, wherein the externally-added inorganic fine particles further comprise small-particle size inorganic particles having a BET surface area exceeding 40 $m^2/g$.

4. The toner according to claim 1, wherein the silica fine particles comprise at least one member selected from the group consisting of titanium oxide-doped silica, alumina-doped silica and titanium oxide-alumina-doped silica.

5. A non-contact development process for development of a toner, which comprises projecting toner which is on a development roller onto an electrostatic latent image carrying member while applying an electric field to the toner, wherein the toner comprises a resin binder, a colorant, and externally-added inorganic fine particles, comprising large-particle size inorganic particles comprising 50% by volume or more of particles having a particle size of from 100 to 583.9 nm, and having a BET specific surface area of 1 to 40 $m^2/g$, wherein the large-particle size inorganic particles are silica fine particles.

6. The process according to claim 5, wherein the externally-added inorganic fine particles further comprise small-particle size inorganic particles having a BET surface area exceeding 40 $m^2/g$.

7. The process according to claim 5, wherein the silica fine particles comprise at least one member selected from the group consisting of titanium oxide-doped silica, alumina-doped silica and titanium oxide-alumina-doped silica.

* * * * *